US010619429B2

(12) United States Patent
Sipos

(10) Patent No.: US 10,619,429 B2
(45) Date of Patent: Apr. 14, 2020

(54) INTEGRATED FLUSH-MOUNT SPIDER AND POWER-TONG APPARATUS AND METHOD OF USE

(71) Applicant: ODFJELL PARTNERS INVEST LTD, Aberdeen OT (GB)

(72) Inventor: David L. Sipos, Youngsville, LA (US)

(73) Assignee: Odfjell Well Services Norway AS, Tananger (NO)

( * ) Notice: Subject to any disclaimer, the term of this patent is extended or adjusted under 35 U.S.C. 154(b) by 155 days.

(21) Appl. No.: 15/593,904

(22) Filed: May 12, 2017

(65) Prior Publication Data

US 2017/0328150 A1 Nov. 16, 2017

Related U.S. Application Data

(60) Provisional application No. 62/335,131, filed on May 12, 2016.

(51) Int. Cl.
*E21B 19/10* (2006.01)
*E21B 19/16* (2006.01)

(52) U.S. Cl.
CPC ..... *E21B 19/161* (2013.01); *E21B 19/10* (2013.01)

(58) Field of Classification Search
CPC ..... E21B 19/161; E21B 19/10
See application file for complete search history.

(56) References Cited

U.S. PATENT DOCUMENTS

| | | | | |
|---|---|---|---|---|
| 3,032,364 | A | 5/1962 | Phillips | |
| 3,202,446 | A | 8/1965 | Long | |
| 5,660,087 | A | 8/1997 | Rae | |
| 6,047,775 | A * | 4/2000 | Mock | E21B 19/163 166/377 |
| 6,142,040 | A * | 11/2000 | Bouligny | E21B 19/161 81/57.16 |
| 6,793,021 | B1 | 9/2004 | Fanguy | |
| 6,910,402 | B2 | 6/2005 | Drzewiecki | |
| 7,188,547 | B1 * | 3/2007 | West | E21B 19/161 81/57.16 |
| 7,267,163 | B2 | 9/2007 | Sipos | |
| 7,775,270 | B1 | 8/2010 | Sipos | |
| 7,891,469 | B1 | 2/2011 | Sipos | |
| 8,235,104 | B1 | 8/2012 | Sigmar et al. | |
| 8,733,213 | B2 | 5/2014 | Taggart | |
| 2010/0032208 | A1 * | 2/2010 | Boyd | E21B 19/166 175/40 |
| 2015/0275594 | A1 * | 10/2015 | Mullins | E21B 19/10 166/78.1 |

* cited by examiner

*Primary Examiner* — David J Bagnell
*Assistant Examiner* — Yanick A Akaragwe
(74) *Attorney, Agent, or Firm* — Roy Kiesel Ford Doody & North, APLC; Brett A. North

(57) ABSTRACT

An apparatus and method for an integrated flush-mount spider and power-tong apparatus comprising a flush-mount spider integrated with an attached power-tong and electronic load cell torque monitor. The power-tong applies rotation in opposite directions to make-up and breakout the pipe string. The flush mount spider holds the lower pipe string in place and serves as a backup tong to prevent rotation of the lower pipe string. The addition of a pipe spinner allows the integrated flush-mount spider and power-tong apparatus to replace a top drive for advancing a wellbore.

18 Claims, 6 Drawing Sheets

INTEGRATED FLUSH-MOUNT SPIDER AND POWER-TONG APPARATUS AND METHOD OF USE

PRIORITY

This application claims priority to U.S. Provisional Application Ser. No. 62/335,131 filed May 12, 2016 for Integrated Flush-Mount Spider And Power-Tong Apparatus And Method Of Use, the entire content of which is incorporated by reference.

FIELD OF THE INVENTION

This invention relates to a tool to make-up and breakout pipe segments in a pipe string for use on oil and gas drilling rigs. More particularly, the invention relates to an integrated spider and tong combination that may be utilized in place of separate equipment more expensive equipment.

BACKGROUND

During the drilling of an oil and gas well, long strings of pipe are created by threadedly connecting shorter pipe segments. The series of connected pipe segments is called a pipe string. The pipe string is usually supported by spider slips placed in an opening on the floor of a drilling rig. When a pipe segment is to be added to the pipe string using a top drive, the spider slips are set to hold and support the weight of the pipe string. A pick up elevator is used to grab and lift a new segment of pipe which is then stabbed into the threaded connection in the pipe string. Separate power tongs are then used to tighten the connection of a desired torque.

The primary advantage of a top drive unit is that, it combines the virtues of a travelling block, with a vertical guide system and a power tong. Its use saves rig time by allowing a more efficient make-up and breakout of the pipe segments that comprise the pipe string than that of a conventional rotary drilling rig. Consequently, using a top drive is typically safer because fewer drill crew workers on the rig floor are required. However, a top drive system is bulky, very expensive, and still requires back-up tongs, pick-up elevators, and a sizeable crew of workers on the rig floor.

Consequently, there is a present need for a compact and less expensive tool that may be utilized on a rig floor in place of a top drive to make-up and breakout pipe segments on a drilling rig floor.

SUMMARY OF THE INVENTION

The disclosed invention is an integrated flush-mount spider and power-tong apparatus to make-up and breakout pipe on a pipe string of an oil and gas chilling rig. The apparatus may be mounted in an opening on the rig floor over the wellbore and is readily removable when it is not needed. The apparatus provides the features of a rotary spider, a backup tong, a power tong, and a torque monitor in compact, single, piece of equipment. The apparatus can be configured so that its power-tong component may be vertically adjusted and positioned as desired so that the power-tong is placed at a convenient working height with respect to the rig floor. The adjustable height of the power-tong component is particularly useful on land rigs.

The torque monitor provided in the disclosed invention utilizes electronic load cells in the head of the power tong for accurate torque measuring and monitoring as torque is applied during make-up of the pipe string. The torque monitor may include a processor to generate and transmit torque readings to a digital display and the monitor may store the torque readings generated during the make-up of the pipe segments. The torque monitor may also utilize other torque measuring devices such as hydraulic load gages for measuring, monitoring, recording applied torque when appropriate.

The disclosed invention will replace a conventional power tong, a torque monitor, and torque reaction cables and is less expensive than individual pieces of equipment. When the disclosed integrated flush-mount spider and power-tong apparatus is provided, only a pipe spinner, which is typically provided on every rig, is needed to advance the pipe string.

The disclosed invention eliminates the need for a top drive and a separate backup tong, Use of the disclosed integrated flush-mount spider and power-tong apparatus will reduce the number of personnel required on the rig floor, safe time, enhance safety, reduce cost, and allow rotary table drilling rigs to be competitive with top-drive rigs by providing most of the advantages associated with the use of a top-drive at a fraction of the cost.

These drawings may omit features that are well established in the art and that do not bear upon points of novelty in the interest of descriptive clarity. Such features include wiring, hoses, hydraulic couplings, pumps, motors, fluid reservoirs, controls, gauges, threaded junctures, weld lines, sealing elements, screws, bolts, pins, and brazed junctures.

DESCRIPTION OF THE INVENTION

Figure 1:
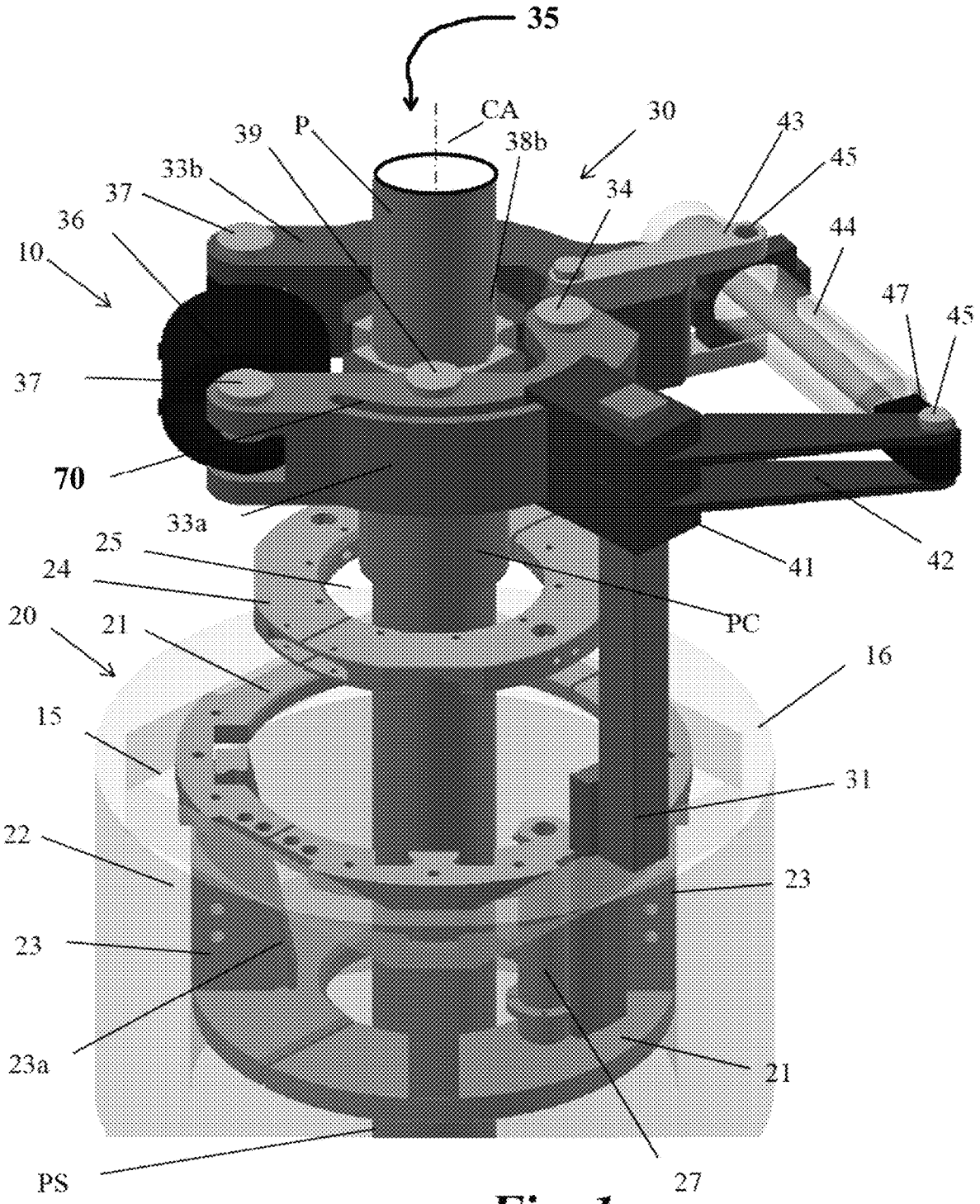
FIG. 1 is a schematic perspective view showing selected features of the integrated flush-mount spider and power-tong apparatus positioned in a rotary table opening on a rig floor.
Figure 2:
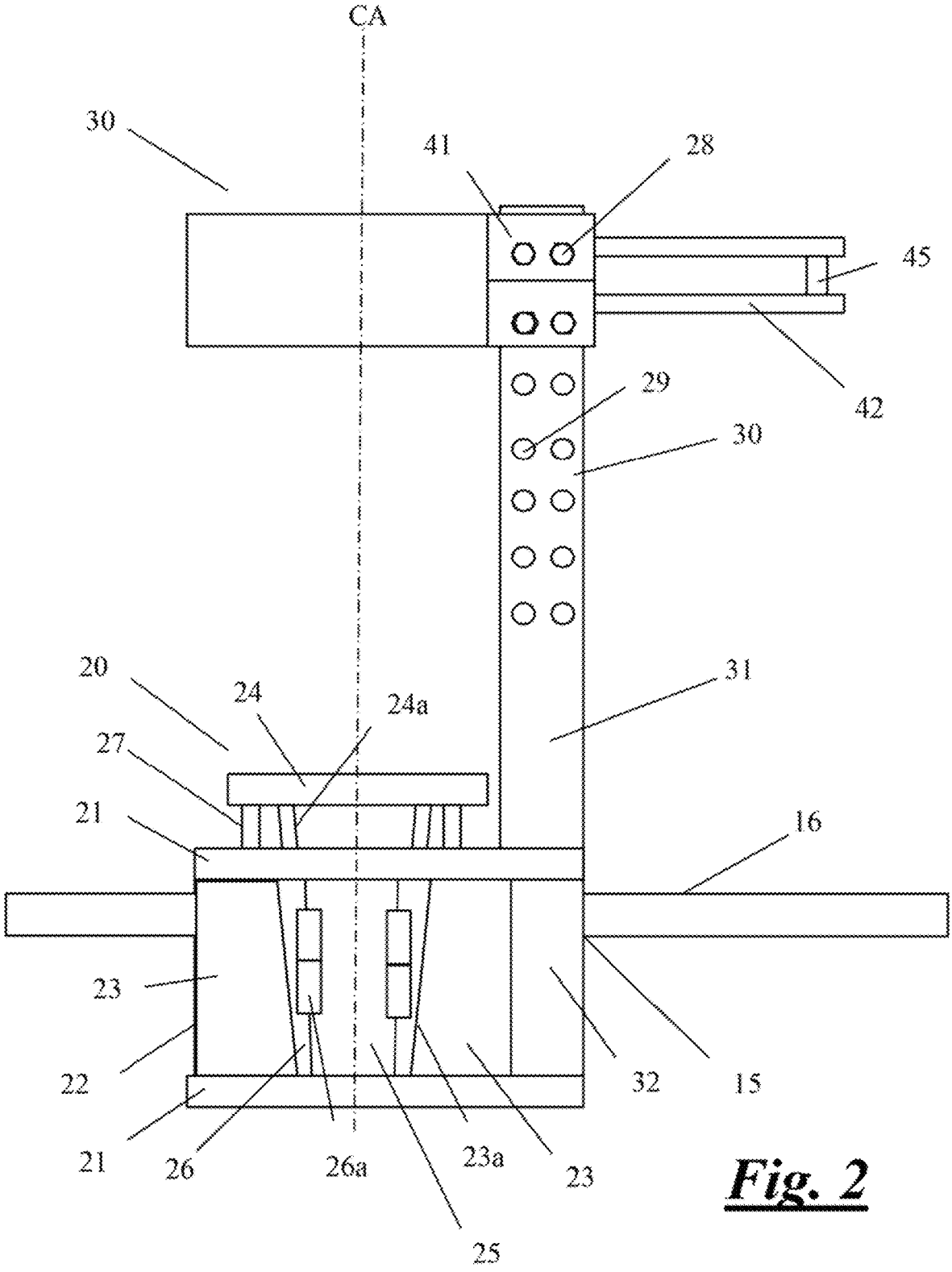
FIG. 2 is a schematic side view of the integrated flush-mount spider and power-tong apparatus shown in FIG. 1.

The spider with integrated power-tong apparatus (10) is shown in FIGS. 1 and 2. The apparatus (10) is comprised of a spider (20) having an integral power tong (30). Preferably spider (20) will be a flush-mount spider configured to fit and rest within, and be readily removable from, an opening (15) in a rig floor (16) with only the upper portion of the spider, preferably no more than 12 inches, extending above the rig floor (16).

For clarity and orientation purposes, only portions of the flush-mount spider (20) are shown in FIG. 1. The flush-mount spider (20) will have a body shown as a slip frame (22) and slips, dies, and a slip manipulation mechanism utilizing linear actuators such as hydraulic rams. Details of a suitable flush-mount spider (20) with slips and dies and slip manipulation mechanisms are shown and described in Applicant's U.S. Pat. No. 7,775,270 for "Spider with Distributed Dies", U.S. Pat. No. 7,267,168 for "Spider with Discrete Die Supports" or in Applicant's U.S. Pat. No. 7,891,469 for "Discrete Element Spider".

FIG. 2 shows a schematic side view of the flush-mount spider with integrated power-tong apparatus (10). The slip frame (22) of the flush-mount spider (20) component of apparatus (10) is comprised of a plurality of slip rails (23), each having an inwardly tapered surface (23*a*), arrayed around a central axis (CA) to create a central opening (25). Slip rail support plates (21) provide lateral support and torque resistance, for the slip frame (22). The slip manipulation mechanism is comprised of timing ring (24) positioned above the central opening (25) by means of a plurality of extendable and retractable hydraulic timing ring rams (27). The timing ring (24) is pivotally attached to a plurality of tapered spider slips (26) by slip links (24*a*). The spider slips (26) are slideably mounted on the slip rails (23) and move vertically upward and downward along the tapered slip rail surfaces (23*a*) and radially inward and outward within opening (25) in response to upward and downward movement of the timing ring (24) by hydraulic rams (27) to grip and release the pipe string (PS). The spider slips (26) are provided with gripping dies (26*a*) to enhance gripping engagement with the pipe string (PS).

Power tong (30) has support blocks (41) where it is adjustably attached to a vertically extending support shown as post (31) that is fixed to brackets (32) mounted on the slip frame (22) of the flush-mount spider (20). Removable fasteners such as bolts or mounting pins (28) inserted into fastener holes (29) along the length of support post (31) may be used to adjustably attach power tong (30) in a desired vertical position on support post (31). The adjustably mounted power tong (30) allows the height of the power tong (30) to be adjusted with respect to the rig floor (16) to facilitate its use.

The power tong (30) has a first jaw (33*a*) and a second jaw (33*b*), each having a first end and a second end, positioned about central axis (CA) to create a central tong opening (35) that is positioned in vertical alignment with the central opening (25) of the flush-mount spider (20). The first jaw (33*a*) and the second jaw (33*b*) of power tong (30) are pivotally attached to each other at their respective first ends by pivot pin (34). A hydraulic jaw ram (36) is pivotally attached by ram pins (37) to extend between the respective second ends of first jaw (33*a*) and second jaw (33*b*). A first gripping die (38*a*) is pivotally attached to the first jaw (33*a*) and a second gripping die (38*b*) is pivotally attached to the second jaw (33*b*) on pivot pins (39) so that gripping dies (38*a*) and (38*b*) oppose each other across the central tong opening (35) of the tong (30).

Figure 3:
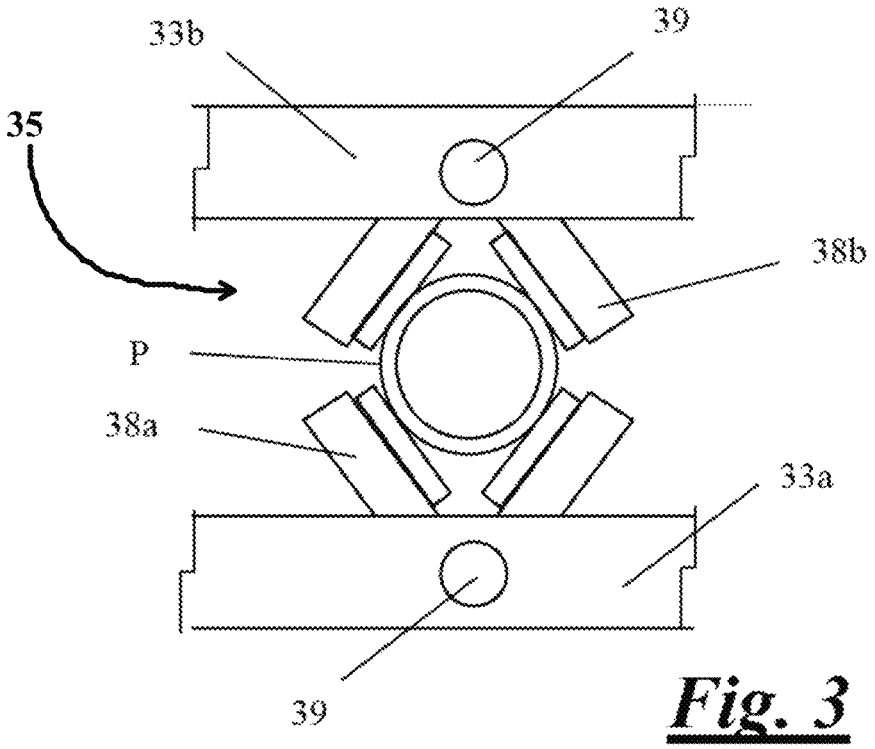
FIG. 3 is a schematic partial top view of the gripping jaws and gripping dies of the power tong component of the integrated flush-mount spider and power-tong apparatus shown in FIG. 1.

As shown in FIG. 3, gripping dies (38*a*) and (38*b*) are V-shaped and are pivotally attached to jaws (33*a*) and (33*b*), respectively, by pin (39). The V-shaped configuration and pivotal attachment of gripping dies (38*a*) and (38*b*) enhance the positioning of gripping dies (38*a*) and (38*b*) against a new pipe segment (P) extending through the central tong opening (35) of the tong (30). Extension and retraction of hydraulic ram (36) will cause the first jaw (33*a*) and the second jaw (33*b*) to pivot on pin (34) to move the first jaw (33*a*) and the second jaw (33*b*) away from and toward each other and thereby closing and opening central tong opening (35) to engage and disengage gripping dies (38*a*) and ($8*b*) with new pipe segment (P).

Power tong (30) is provided with a torquing mechanism (40) comprised of a first torque arm (42) mounted to and extending outwardly from the support block (41), a second torque arm (43) mounted to and extending outwardly from the second end of the second jaw (33*b*), and a hydraulic torque ram (44) pivotally attached to the outward ends of the first torque arm (42) and the second torque arm (43) by pivot pins (45). Extension and retraction of hydraulic ram (44) of the torquing mechanism (40) will cause the power tong (30) to slide on the support blocks (41) along guide slot (70) on jaw (33*a*) to rotate the power tong (30) about central axis (CA). When the jaws (33*a*) and (33*b*) are moved to a closed position to engage gripping dies (38*a*) and (38*b*) with new pipe segment (P), new pipe segment (P) will be rotated as the power tong (30) is rotated.

Figure 4:
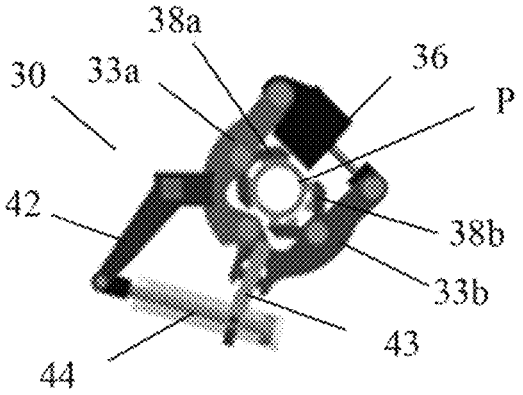
FIGS. 4-7 are schematic top views showing the opening, closing, and rotation of the power-tong during the make-up of a pipe joint.
Figure 5:
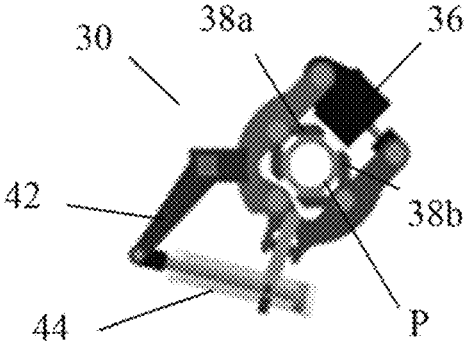
Figure 6:
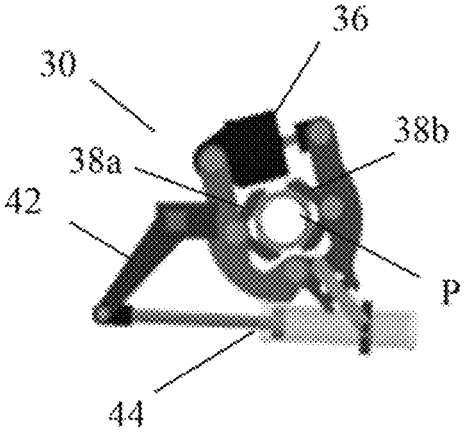
Figure 7:
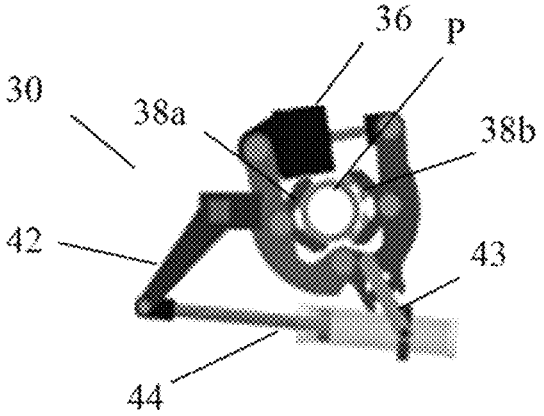

Torquing mechanism (40) may be provided with a torque monitor (47). Torque monitor (47) may include at least one electronic load cell, preferably a compression load cell, positioned on torque rant (44). Torque monitor (47) may also have an analog, or digital display to advise a user of the torque applied during connection of a new pipe segment (P). Torque monitor (47) may also include an audible alarm to advise the user when the applied torque is over or under a desired torque setting. Torque monitor (47) may also include a memory to store readings of the torque applied to each successive pipe segment. Torque monitor (47) may be mounted on the power tong (30) or it may be located remote from the power tong FIGS. 4-7 show the torquing sequence for make-up of a new pipe segment (P) to a pipe string (PS) with the apparatus (10). In FIG. 4, hydraulic ram (36) of power tong (30) is extended to open gripping dies (38*a*) and (38*b*) allowing the new pipe segment (P) to be placed through the central tong opening (35) of the tong (30) for engagement with pipe collar (PC) of pipe string (PS) held in place by spider slips (26) of spider (20). Hydraulic ram (36) is then retracted to close gripping dies (38*a*) and (38*b*) to engage new pipe segment (P) as shown in FIG. 5. With the pipe string (PS) held by slips (26) of spider (20), and the new pipe segment (P) engaged with gripping dies (38*a*) and (38*b*), hydraulic ram (44) of the torquing mechanism (40) of power tong (30) is extended as shown in FIG. 6 to rotate the pipe segment (P) onto threaded engagement with pipe string (PS) to a desired torque to make-up new pipe segment (P) with pipe string (PS). Hydraulic ram (36) of power tong (30) is then extended to open gripping dies (38*a*) and (38*b*) as shown in FIG. 7 to allow the process to be repeated. The spider (20) serves to hold pipe string (PS) in place in the wellbore and as well as a backup tong to prevent rotation when the pipe spinner and the power-tong (30) rotate new pipe segment (P). The torque applied to rotate new pipe segment (P) onto pipe string (PS) is measured and monitored by a torque monitor (47) at the ram end of torque ram (44). The process may then be repeated to farther threadedly engage new pipe segment (P) with pipe string (PS) until a desired torque is reached. The process is reversed to breakout the pipe string (PS) when removing the pipe string from the wellbore.

Figure 8:
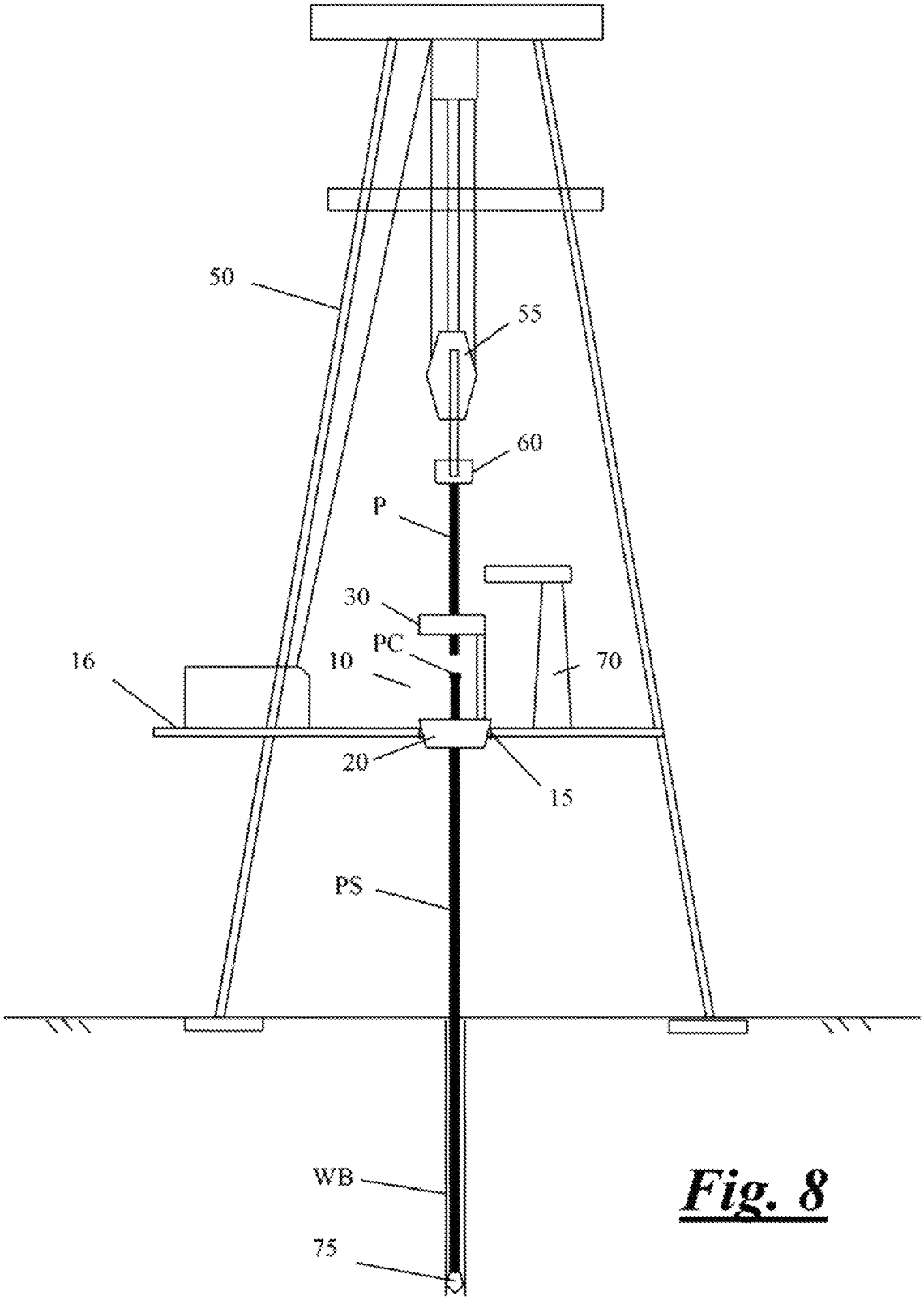
FIGS. 8 and 9 illustrate the use of the integrated flush-mount spider and power-tong apparatus of FIG. 1 for pipe make-up, breakout, and advancement of the wellbore.
Figure 9:
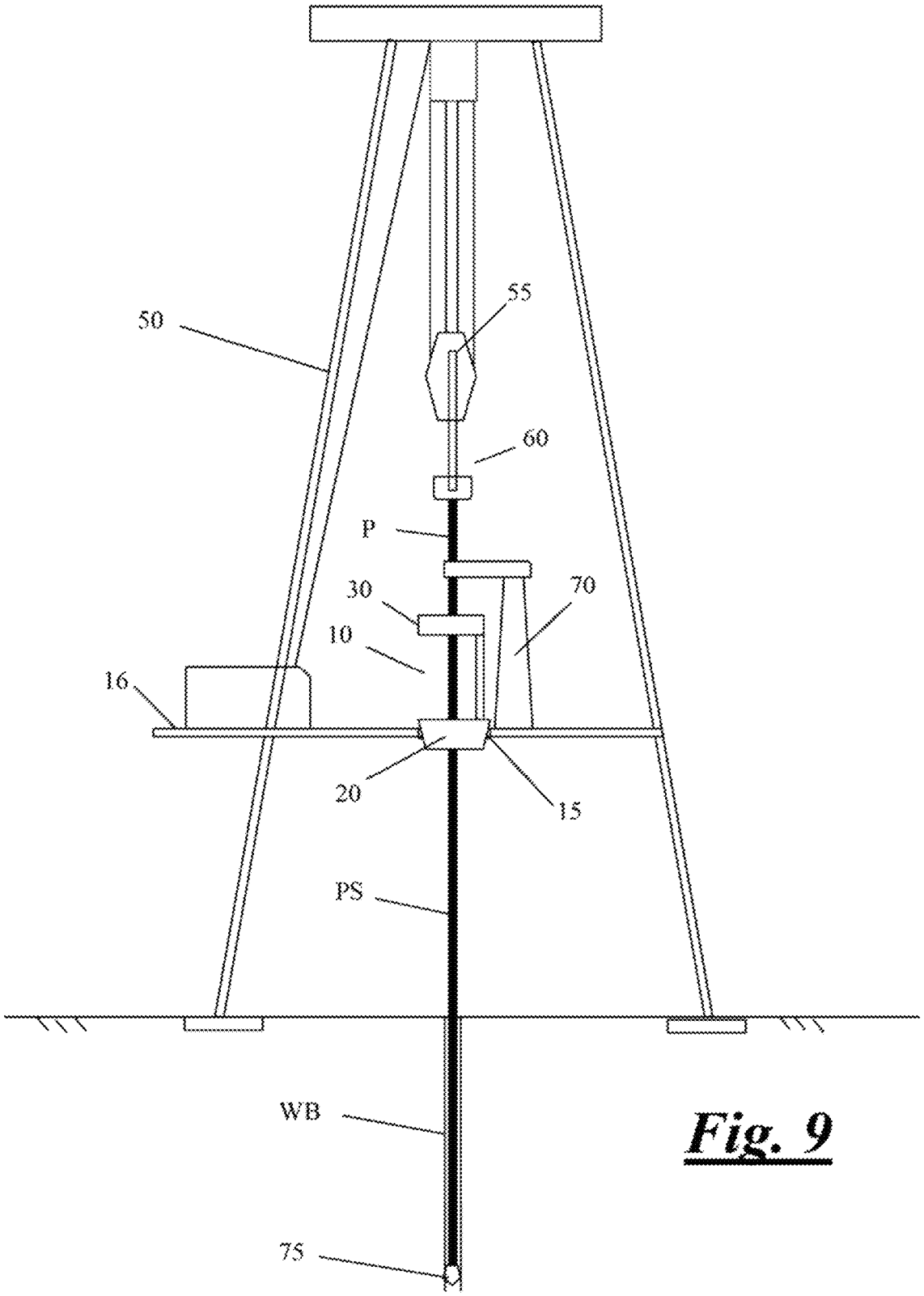

FIGS. 8 and 9 show the process of making up the pipe string (PS) with a conventional rig (50). The spider component (20) of the apparatus (10) is fitted into rotary table opening (15) of the rig floor (16) and the power-tong (30) is adjusted vertically on support (31) to a desired position with respect to the rig floor (16). The rig drawworks (55) is then attached to elevator (60). Elevator (60) is then placed to rotatably support a new pipe segment (P) to be added to pipe string (PS). With hydraulic rant (36) of power tong (30) extended to open gripping dies (38*a*) and (38*b*) in central tong opening (35) of tong (30), and with the while the pipe string (PS) is being held by the spider (20), elevator (60) is used to move new pipe segment (P) into the central tong opening (35) to stab the pipe collar (PC) of the pipe string (PS).

Power-tong (30) of apparatus (10) is then used to make-up pipe segment (P) with pipe string (PS) as shown and described in FIGS. 4-7. The slips (26) of the spider (20) of apparatus (10) are closed to hold pipe string (PS) in place in the wellbore (WB) to prevent its rotation during make-up of new pipe segment (P). The slips (26) of spider (20) are then opened to release the pipe string (PS) and the pipe string (PS) is further lowered into the wellbore (WB) by elevator (60) to a position. New pipe segment (P) is then gripped by closing slips (26) of spider (20) allowing elevator (60) to be disengaged to connect another new pipe segment (P). The process may be reversed to breakout a pipe (P) from pipe string (PS) to remove the pipe stung (PS) from the well bore.

Apparatus (10) may also be used with a pipe spinner (70) as shown in FIG. 9 to rotate the pipe string (PS) and the drill bit (75) to advance pipe string (PS) in wellbore (WB). This will eliminate the need for a top drive mechanism for rotating the pipe string (PS).

It is thought that the integrated flush-mount spider and power-tong apparatus (10) presented herein as well as its attendant advantages will be understood from the foregoing description. It is also thought that it will be apparent that various changes may be made in the form, construction, and arrangement of the parts thereof without departing from the spirit and scope of the invention or sacrificing all of its material advantages, the form herein being merely in example embodiment of the invention.

I claim:

1. An apparatus to make-up and breakout pipe segments in a pipe string comprising:

(a) a spider having a body with a central opening with a central axis, said spider body having a plurality of slip guides, a pipe gripping slip slidably mounted on each said slip guide, each said slip having a slip gripping surface, a timing ring pivotally attached to each said slip, an extendable and retractable spider ram attached to said timing ring whereby said slips will move radially inward and outward with respect to said central axis of said spider body upon extension and retraction of said spider ram;

(b) a vertically extending support attached to said spider, said support adjustably attached to a support block;

(c) a power tong having first and second pivotally attached gripping jaws, said first gripping jaw having a guide slot whereby said first gripping jaw is slidably mounted to said support block;

(d) an extendable and retractable jaw ram whereby said first and second pivotally attached gripping jaws may be opened and closed upon extension and retraction of said jaw ram, said jaw ram and said first and second pivotally attached gripping jaws enclosing a central tong opening positioned in vertical alignment with said central opening of said spider;

(e) a torquing arm pivotally attached to said first gripping jaw; and (f) an extendable and tractable torque ram pivotally attached to said second gripping jaw and said torquing arm whereby said first gripping jaw slides along said guide slot for rotation of said gripping jaws upon extension and retraction of said torquing ram.

2. The apparatus recited in claim 1, further comprising gripping dies mounted to said gripping jaws.

3. The apparatus recited in claim 2, wherein said gripping dies mounted to said gripping jaws are V-shaped.

4. The apparatus recited in claim 3, wherein said gripping dies are pivotally mounted to said gripping jaws.

5. The apparatus recited in claim 4, further comprising a torque monitor attached to said gripping jaws.

6. The apparatus recited in claim 5, wherein said torque monitor includes an electronic load cell.

7. The apparatus recited in claim 6, wherein said apparatus is mounted in an opening in the rig floor of a drilling rig.

8. The apparatus recited in claim 7, further comprising:

(a) a pipe string positioned in said central opening of said spider, said pipe string grippingly engaged with said spider by said pipe gripping slips; and (b) a pipe segment grippingly engaged with said gripping dies of said gripping jaws and said pipe string; and (c) whereby rotation of said gripping jaws by extension of said, torque ram will thereby rotate said pipe segment and thereby connect said pipe segment to said pipe string.

9. The apparatus as recited in claim 8, wherein said power tong is vertically adjustable with respect to said rig floor around said central axis of said spider body by adjusting the position of said adjustably attached support block on said vertically extending support.

10. A pipe make-up and breakout apparatus comprising:

(a) a spider having a body with a central opening with a central axis, said spider body having a plurality of slip guides, a pipe gripping slip slidably mounted on each said slip guide, each said slip having a gripping surface, a timing ring pivotally attached to each said slip, an extendable and retractable spider ram attached to said timing ring whereby said slips and said slip gripping surface will move radially inward and outward with respect to said central axis upon extension and retraction of said spider ram, said spider body positioned in an opening in the floor of a drilling rig;

(b) a vertically extending support attached to said spider;

(c) a power tong adjustably mounted to said vertically extending support above said central opening of said spider body, said power tong having a first gripping jaw and a second gripping jaw, said first gripping jaw and said second gripping jaw each having a first end and a second end, said first gripping jaw slidably attached to said vertically extending support, said first gripping jaw and said second gripping jaw pivotally attached to each other at the it respective said first end, a jaw ram pivotally attached between the respective said second end of said first gripping jaw and second gripping jaw, thereby creating a central tong opening around said central axis of and in vertical alignment with said central opening of said spider body and whereby said gripping jaws may be opened and closed over said central opening of said spider upon extension and retraction of said jaw ram;

(d) a torquing mechanism having a torque arm with inward torque arm end and outward torque arm end, wherein said inward torque arm end being mounted to said vertically extending support and a torque ram pivotally attached between said second gripping jaw and said outward torque arm end of said torque arm; and (e) whereby said gripping jaws may be rotated upon extension and retraction of said torque ram.

11. The apparatus recited in claim 10, further comprising V-shaped gripping dies pivotally mounted to said gripping jaws.

12. The apparatus recited in claim 10, further comprising:

(a) a pipe string positioned in said central opening of said spider, said pipe string attached to said spider by said pipe gripping slips; and (b) a pipe segment engaged with said gripping dies of said gripping jaws and said pipe string; and (c) whereby rotation of said gripping jaws by extension of said torque ram will thereby rotate said pipe segment and thereby connect said pipe segment to said pipe string.

13. The apparatus as recited in claim 12, wherein retraction of said torque ram will thereby rotate said pipe segment and thereby disconnect said pipe segment from said pipe string.

14. The apparatus recited in claim 12, further comprising a torque monitor attached to said gripping jaws.

15. The apparatus recited in claim 14, wherein said torque monitor includes an electronic load cell.

16. The apparatus recited in claim 14, wherein said spider is a flush mounted spider.

17. The apparatus recited in claim 14, wherein said power tong is adjustably mounted to said vertically extending support by an adjustably mounted support block, said support block slidably mounted to said first gripping jaw of said torquing mechanism whereby said first gripping jaw slides along a guide slot during rotation of said gripping jaws.

18. The apparatus recited in claim 17, whereby the vertical position of said torquing mechanism with respect to said spider body may be adjusted by adjusting the vertical position of said support block on said vertical support.

* * * * *